US005924420A

United States Patent [19]

Reischel et al.

[11] Patent Number: 5,924,420

[45] **Date of Patent: *Jul. 20, 1999**

[54] FULL FACE RESPIRATOR MASK HAVING INTEGRAL CONNECTORS DISPOSED IN LENS AREA

[75] Inventors: Joseph G. Reischel, Woodbury; Vaughn B. Grannis, Inver Grove Heights; David P. Knivsland, North St. Paul, all of Minn.

[73] Assignee: Minnesota Mining and Manufacturing Company, St. Paul, Minn.

[ * ] Notice: This patent issued on a continued prosecution application filed under 37 CFR 1.53(d), and is subject to the twenty year patent term provisions of 35 U.S.C. 154(a)(2).

[21] Appl. No.: 08/727,340

[22] Filed: Sep. 24, 1996

Related U.S. Application Data

[51] Int. Cl.[6] ..... A62B 18/02; A62B 18/08; A62B 19/00

[52] U.S. Cl. ..... 128/206.21; 128/206.28; 128/206.17; 128/206.23

[58] Field of Search ..... 128/201.24, 202.27, 128/201.12, 201.14, 201.15, 206.12, 206.15, 206.17, 206.21, 206.28, 207.12, 206.23

[56] References Cited

U.S. PATENT DOCUMENTS

| | | | |
|---|---|---|---|
| Re. 35,062 | 10/1995 | Brostrom et al. | 128/206.12 |
| D. 249,368 | 9/1978 | Watkins, Jr. | 128/206.28 |
| D. 378,610 | 3/1997 | Reischel et al. | D24/110.2 |
| D. 388,872 | 1/1998 | Grannis et al. | D24/110.4 |
| 2,740,400 | 4/1956 | Wines | 128/206.17 |
| 2,905,172 | 9/1959 | Rodenhouse | 128/201.12 |
| 2,951,418 | 9/1960 | Bitner et al. | 128/201.12 |
| 2,965,902 | 12/1960 | Louch | 128/206.28 |
| 3,146,295 | 8/1964 | Roland | 128/201.12 |

(List continued on next page.)

FOREIGN PATENT DOCUMENTS

| | | | |
|---|---|---|---|
| 0 511 592 A1 | 11/1992 | European Pat. Off. | A62B 9/04 |
| 0 511 593 A1 | 11/1992 | European Pat. Off. | A62B 18/02 |
| 1 184 646 | 12/1964 | Germany . | |
| 2 268 076 | 1/1994 | United Kingdom | A62B 18/08 |
| WO 91/01159 | 2/1991 | WIPO | A62B 18/10 |
| WO 92/19322 | 11/1992 | WIPO | A62B 18/02 |
| WO 93/14819 | 8/1993 | WIPO | A62B 18/02 |
| WO 95/09676 | 4/1995 | WIPO | A62B 18/08 |

OTHER PUBLICATIONS

Neoterik product literature for "Full–Feature Full–Face Technirama" face mask.

MSA product literature for "Advantage 1000 Low Maintenance–Respirator" (TAL499(L)REV.2), 1991.

ISI product literature for "ISI Fit For Use" custom fit repirator, Lawrenceville, GA 30243.

Scott product literature for "Half– and Full–Facepiece Twin Cartidge Respirators"(H/S 5384D 1992).

Cairns & Brother product literature for "CairnsIRIS", Clifton, N.J. 07012.

(List continued on next page.)

*Primary Examiner*—Kimberly L. Asher
*Attorney, Agent, or Firm*—Gregory A. Sebald; Karl G. Hanson

[57] ABSTRACT

A full face respirator mask (10) includes a face shield portion (12) with the seal (20) surrounding a lens portion (14). Inhalation ports (16) and an exhalation port (18) are formed at the lower portion of the lens (14). A center adapter (30) includes a nose cup (40) and an exhalation valve (38) in the center orifice (18). The inhalation ports (16,116) are placed at each side of the exhalation port (18) and include connector portions (50,150) formed with the lens (14) or ultrasonically welded to the lens (14). The connector portions (50) include male connectors (58) in a first embodiment and female connectors (150) in a second embodiment receiving complementary formed connectors of a breathable air source.

8 Claims, 7 Drawing Sheets

U.S. PATENT DOCUMENTS

| | | | |
|---|---|---|---|
| 3,182,658 | 5/1965 | Klinger | 128/201.12 |
| 3,545,436 | 12/1970 | Holloway | 128/141 |
| 3,680,555 | 8/1972 | Wancke | 128/141 R |
| 4,057,057 | 11/1977 | Backlund | 128/142.4 |
| 4,069,516 | 1/1978 | Watkins, Jr. | 2/428 |
| 4,167,185 | 9/1979 | Lewis | 128/146.7 |
| 4,574,799 | 3/1986 | Warncke | 128/206.24 |
| 4,595,003 | 6/1986 | Shoemaker et al. | 128/206.17 |
| 4,739,755 | 4/1988 | White et al. | 128/206.12 |
| 4,841,953 | 6/1989 | Dodril | 128/202.27 |
| 4,881,538 | 11/1989 | Angell | 128/201.15 |
| 5,069,205 | 12/1991 | Urso | 128/201.24 |
| 5,080,092 | 1/1992 | Tenna | 128/201.19 |
| 5,454,369 | 10/1995 | Müller et al. | 128/206.21 |
| 5,555,569 | 9/1996 | Lane | 2/424 |

OTHER PUBLICATIONS

Pro–Tech product literature for "Air Supplied Respiratory Protection Equipment" (1993) Buchanan, MI.

MSA product literature for "The Advantage 1000 Low–Maintenance Respirator" (Bulletin 1012–02 1993), Pittsburgh, PA 15230.

Scott "Health & Safety Full–Line Catalog" (H/S 5693 Mar. 1994), Monroe, NC 28112.

MSA product literature for "The Ultra Elite Facepiece" (Bulletin 0505–02 1994), Pittsburgh, PA.

Fernez product literature for "Cosmo the Innovative Mask".

MSA product literature for "Optimair 6A PAPR with Optifilter Cartridges" (1992), Pittsburgh, PA.

MSA product literature for "Constant Flow or Pressure Demand Duo–Flo and Duo–Twin Respirators" 1988, Pittsburgh, PA 15230.

Scott product literature for "Weld–O–Vista", 1994, Monroe, NC, 28112 H/S 56933/94.

FULL FACE RESPIRATOR MASK HAVING INTEGRAL CONNECTORS DISPOSED IN LENS AREA

TECHNICAL FIELD

The present invention relates to a full face respirator mask having a connector for a breathable air supply integrally formed with the mask face shield.

BACKGROUND

Respirators providing for a breathable air supply to a wearer are well known and have been used for many years. Such masks are used by firefighters, in the military, and industries where the air supply may be contaminated. In addition to providing a clean air source to the nose and mouth for breathing, full face shields also provide a seal to protect the eyes and face from harmful or irritating gases and other substances. Such masks typically include a transparent face shield and may also include mounts for accepting detachable and replaceable filter elements or connectors to air supplies. Such mounts often are threaded connectors that require considerable time and effort to attach and detach and do not provide a stop at a positive locking position.

It can be appreciated that the utility of such a mask is increased if the visual range of the wearer has minimal obstructions. Therefore, the size of the transparent face shield should be maximized. Prior full face shields have provided sufficient coverage to the face but have failed to provide a sufficiently large visual range. Attachment devices for the breathable air source have typically been mounted into a nontransparent rubber portion extending upward at the bottom of the mask, thereby reducing the size of the lens portion and the viewing area at the bottom portion of the face shield. Because of the weight of detachable filters or air hoses and connectors, it is usually necessary to increase the thickness of the respirator body surrounding the inhalation ports to provide sufficient rigidity to hold the air source connector or filter cartridge in position, resulting in additional weight added to the mask. The elimination of thick rubber attachment portions decreases the overall weight of the mask providing better comfort for the wearer. It can be appreciated that when such full face respirator masks are worn for extended periods of time, the weight of the mask and comfort for the wearer have increased importance.

An example of a full face respirator mask is North Safety Equipment's Model 7600 series respirator. The full facepiece of North has orifices formed therethrough for receiving breathable air. The orifices, however, require the attachment of separate mounting hardware mechanically attached to the facepiece for connecting to a breathable air source. The North facepiece requires a separate cartridge connector and a grommet mounting to the facepiece for mating to a connector of a breathable air source. If the connector pieces are not properly tightened, the mask may leak or the connector assembly may rotate in the orifice. Some filter cartridges are oriented to a specific position and may become misaligned should they rotate, possibly impairing the wearer's visual field.

SUMMARY

In light of the above discussion, it can be seen that a new and improved mask is needed which provides greater visibility and which is light weight in construction. Such a mask should provide for attaching filter elements or air supply connectors directly into the face shield having a larger lens portion and increased area of visibility. Such a full face respirator mask also should be easily assembled and light weight to provide maximum comfort for the wearer. In addition, such a mask should provide full coverage and seal off the entire area of the wearer's face. Connections for air sources should be secure and provide for quick and easy attachment and detachment. The present invention addresses these as well as other problems associated with full face respirator masks.

The present invention is directed to a full face respirator mask that receives filters or air supply connectors providing for a fresh breathable supply of air. The present invention includes a full face shield with a lens portion that is transparent and covers the wearer's eyes, nose and mouth. A frame and seal is formed around the face shield portion to provide an airtight seal against the wearer's face. A harness and strap assembly connects around the seal and frame to hold the mask in proper position comfortably against the wearer's face.

The face shield includes a transparent lens portion that extends substantially over the entire wearer's face. Orifices are formed at a lower section of the lens portion which provide connectors for a breathable source such as replaceable and interchangeable filters, or positive pressure air supplies. In one embodiment, an orifice provides for receiving a nose cup and exhalation port providing outward air flow from the interior of the respirator mask. An inhalation port, or ports provide for the inward flow of air. In the embodiments shown, ports are positioned at either side of the exhalation port.

The inhalation ports include connectors that are formed directly into the lens portion or are ultrasonically welded to the lens portion forming a monolithic lens and connector element in a preferred embodiment. The connector portions may include inhalation valves proximate the ports to control and limit the air flow through the ports to the inward direction only. In one embodiment, each of the connectors includes a male portion that extends outward and mates with a complementary female connector portion on the interchangeable filters or air supply connectors. The male connector portions include a plurality of tabs arranged about the exterior of the male connector. The tabs extend into slots formed in the breathable air supply connectors. In a preferred embodiment, the tabs may include differing widths or heights or are spaced at different intervals to provide for alignment or orientation of the filter cartridges. The orifice through the connector portion includes cross pieces supporting a barbed portion inserting into and supporting the inhalation valve. In another embodiment, each of the connectors includes a female portion molded into the lens configured for receiving a complementary male connector from a breathable air source.

The configuration of the lens and connectors provides for easier assembly than prior face mask devices. In addition, the connectors are formed in the lens assembly to provide more viewing area around the connectors as well as an overall increased range of vision. Moreover, the integrally formed connectors provide a stronger yet light weight connection to the face shield which provides for orienting the connected element while eliminating the possibility of leaking through a mechanical connection.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

BRIEF DESCRIPTION OF THE DRAWINGS

In the drawings, wherein like reference letters and numerals designate corresponding elements throughout the several views.

DETAILED DESCRIPTION OF DRAWINGS

Figure 1:
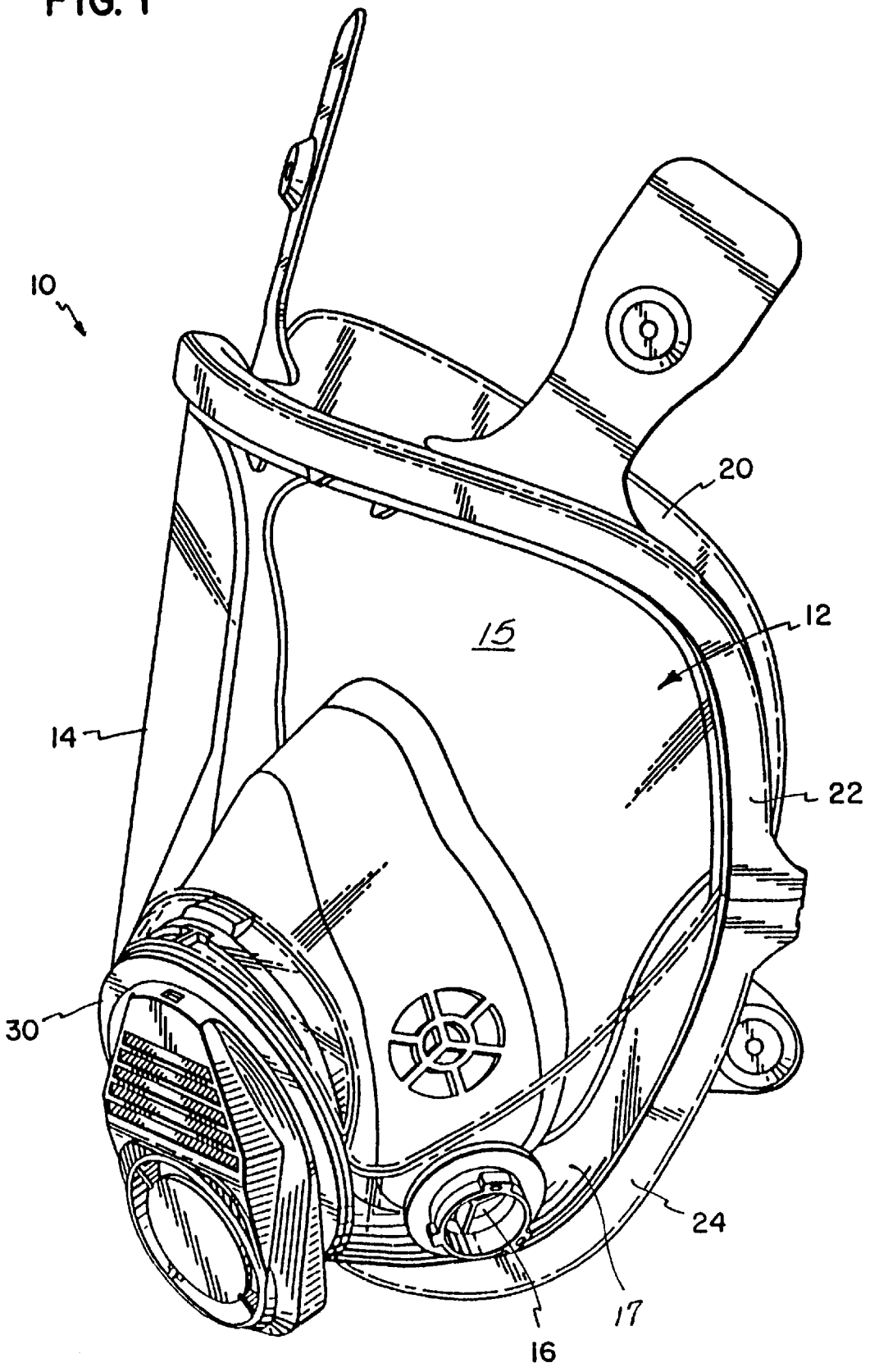
FIG. 1 shows a front perspective view of a full face respirator mask according to the principles of the present invention.
Figure 2:
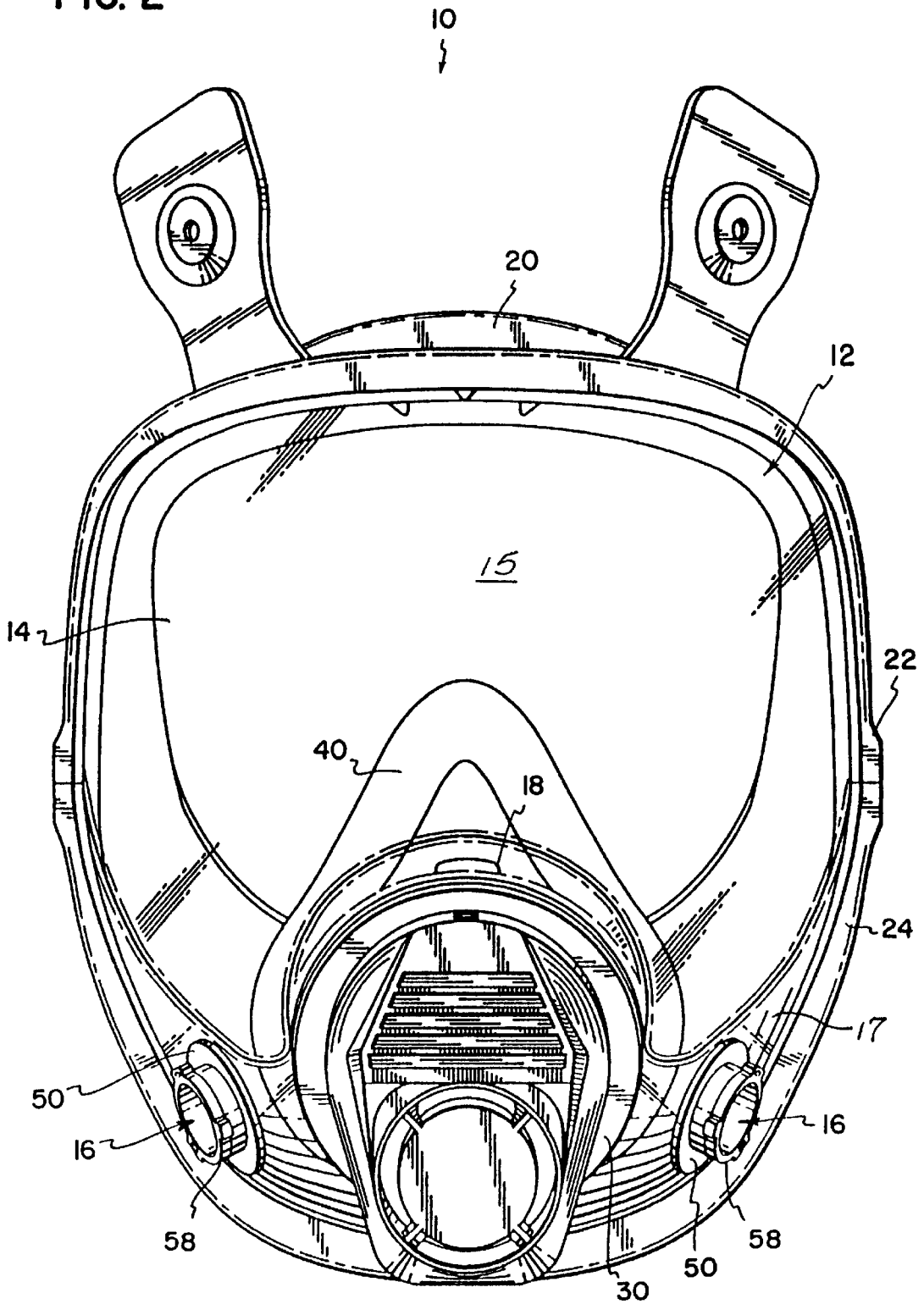
FIG. 2 shows a front elevational view of the respirator mask shown in FIG. 1.

Referring in particular to FIGS. 1 and 2, there is shown a respirator mask, generally designated 10. Respirator mask 10 is a full face respirator mask that provides coverage of substantially the entire area over a wearer's face, including coverage of the eyes, nose and mouth. Respirator mask 10 includes a face shield 12 with a face seal 20 surrounding a rigid plastic lens 14. The face seal 20 prevents vapors, fumes, dust, mists, and other irritants and harmful gasses and fluids from coming into contact with the wearer's face. The rigid plastic lens 14 includes a transparent viewing portion 15 and a port portion 17. The port portion 17 is disposed beneath the viewing portion 15 when the mask is viewed from a front elevation as shown in FIG. 2. Port portion 17 contains first and second intake ports 16 disposed on opposing sides of an exhalation port 18.

Figure 3:
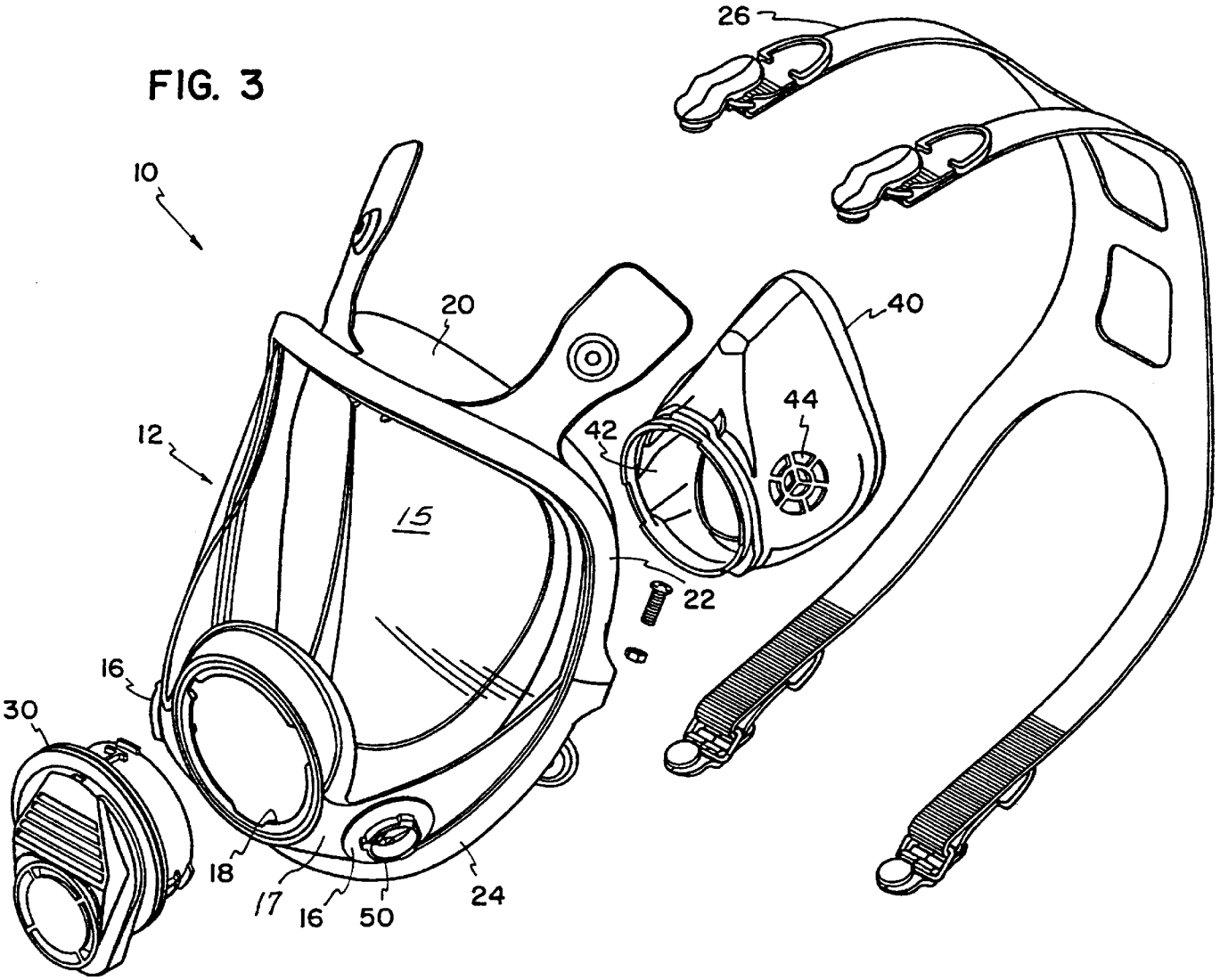
FIG. 3 shows an exploded perspective view of the respirator shown in FIG. 1.

As shown in FIG. 3, the full face respirator mask 10 includes a harness assembly 26 connecting to the mask and extending around the back of a wearer's head for supporting the mask 10 over the wearer's face. Respirator mask 10 also includes an upper frame member 22 connecting to a lower frame member 24 extending around the face shield 12 and the face seal 20.

Figure 6:
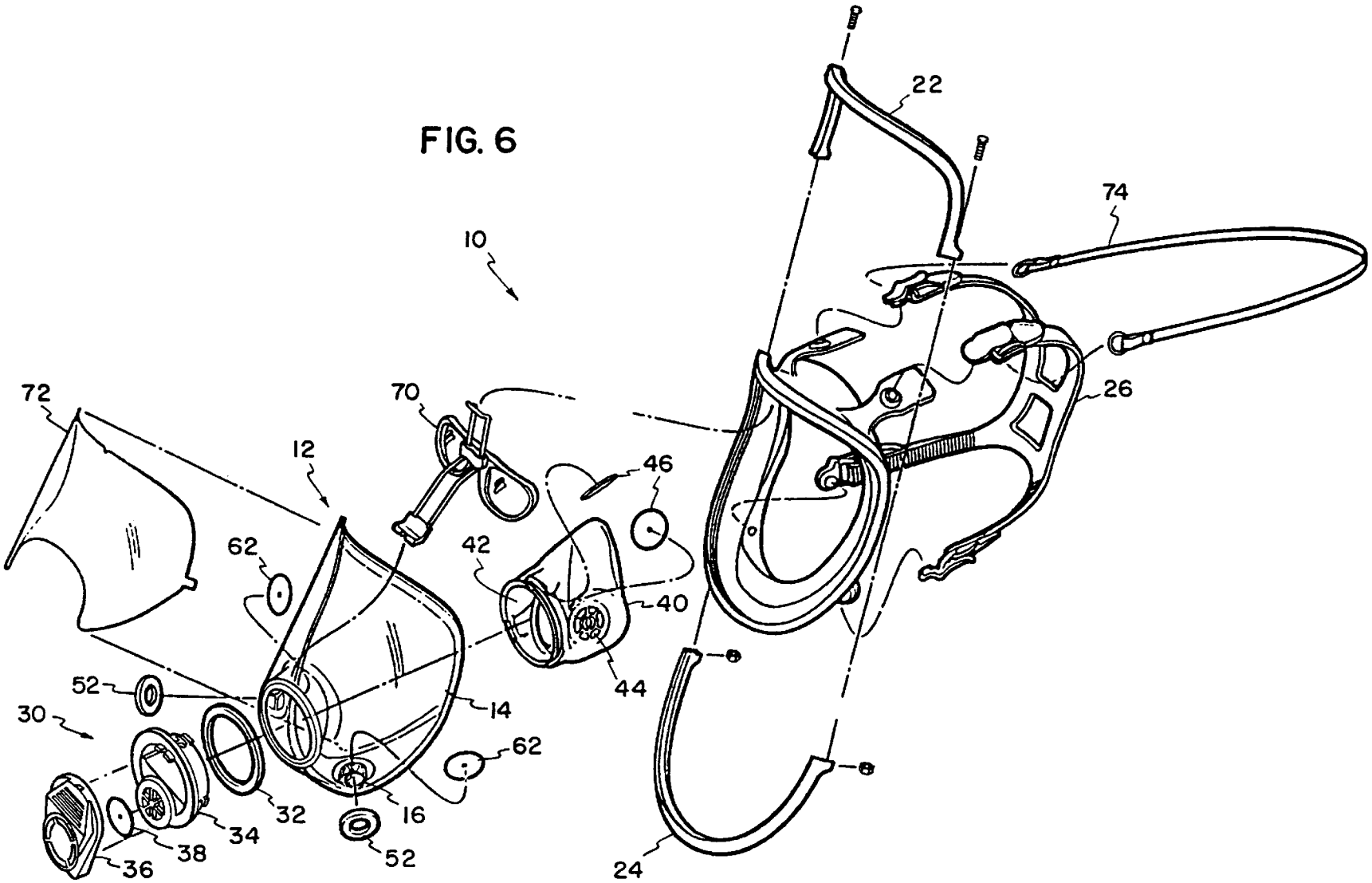
FIG. 6 shows an exploded perspective view of a second embodiment of a full face respirator mask according to the principles of the present invention.

The exhalation port 18 is configured for receiving and aligning a center adapter 30 on which fits a nose cup 40 fitting against the wearer's face and generally covering the mouth and nose. As shown in FIG. 6, the center adapter 30 includes a center adapter gasket 32 fitting against the periphery of the exhalation port 18 and a center adapter base 34. The center adapter base 34 receives an exhalation valve 38 allowing flow outward, but not inward, thereby providing improved breathing for the wearer. A center adapter cover 36 mounts over the center adapter base 34. The center adapter 30 may also include a speaker device (not shown) providing improved communication for selected uses.

In one embodiment, the nose cup 40 includes a center orifice 42 fitting to the center adapter 30. The nose cup 40 also includes inhalation valve orifices 44 receiving inhalation valves 46 which allow one way flow inward but not outward. The valves 46 are positioned at each side of the interior of the nose cup 40 in the embodiment shown.

Each face shield inhalation port 16 includes a bayonet type connector 50 that is configured for receiving a complementary connector member of a breathable air source, such as an interchangeable and replaceable filter cartridge or an air supply connector. The connectors 50 are "integral" with the lens 14, that is the connectors 50 are glued to, welded, molded or otherwise formed with the lens 14 rather than mechanically fastened. The plastic bayonet connector portion 50 is preferably either ultrasonically welded directly to the plastic lens 14 or is directly molded or otherwise formed with the lens portion 14 to form a monolithic continuous element. A seal ring 51 that protrudes from the len's surface and encompasses the inhalation port 16 may be provided to assist in forming a hermetic seal between the lens 14 and the connector 50.

It is appreciated that the direct attachment provides for an enlarged transparent lens 14 and greater viewing area directly abutting and surrounding the bayonet connector portion 50, thereby improving the wearer's visibility. The integral lens 14 and connectors 50 provide a stronger connection than the mechanical connections of the prior art. The face shield is also shown in U.S. Design patent application Ser. No. D 29/060,111 entitled "Full Face Respirator Lens" filed on the same day as this application (attorney Docket Number 52774USA3A), the disclosure of which is wholly incorporated herein by reference.

Figure 4:
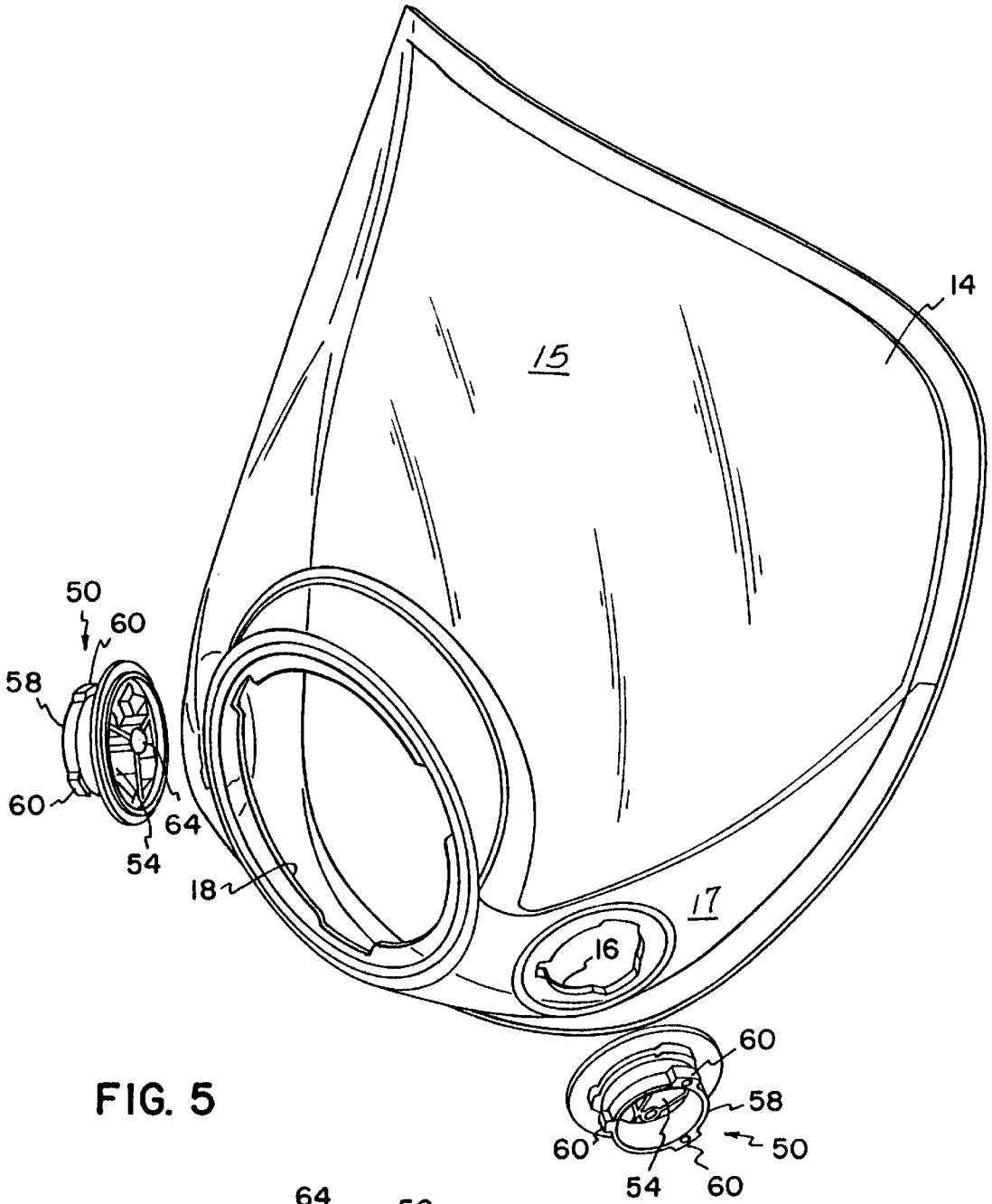
FIG. 4 shows a perspective view of a first embodiment of a lens and port element for the respirator shown in FIG. 1.
Figure 5:
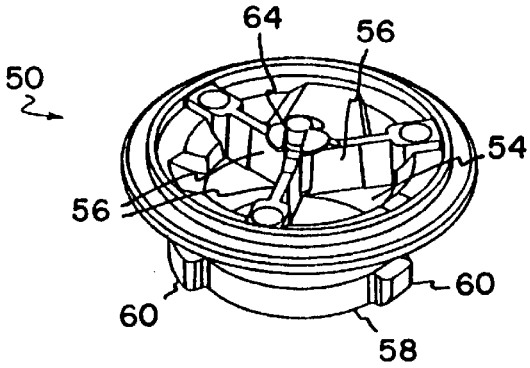
FIG. 5 shows a perspective view of a male bayonet type connector for the respirator mask shown in FIG. 1.

As shown in FIGS. 4 and 5, each of the connector portions 50 includes a male connector section 58 having radially extending tabs 60 which mate with corresponding slots in the female connector on the breathable air supply connectors (not shown) for connecting the cartridges directly to the lens portion 14. The bayonet type connector 50 inserts into a complementary connector portion of a breathable air source connector and is rotated to engage the tabs 60 until the tabs engage the ends of the corresponding slots, providing a positive rotational stop point. In a preferred configuration, the radially outward extending tabs 60 are spaced at differing intervals or have differing heights or widths to provide aligning in complementary slots in the breathable air source connectors. This configuration provides for automatically aligning and orienting air filter cartridges, as some cartridges may be non-symmetrical, or otherwise require a specific orientation relative to the respirator mask 10.

As shown in FIG. 6, each bayonet connector portion 50 includes a gasket 52 that fits over the male connector section 58. An inhalation valve 62 is preferably a flexible planar member connecting onto the inside of the inhalation port 16 and includes a center orifice receiving a barb type projection 64. The barb type projection 64 is supported on cross pieces 56 in the orifice 54 of the bayonet connector 50, as shown most clearly in FIGS. 4 and 5.

Figure 7:
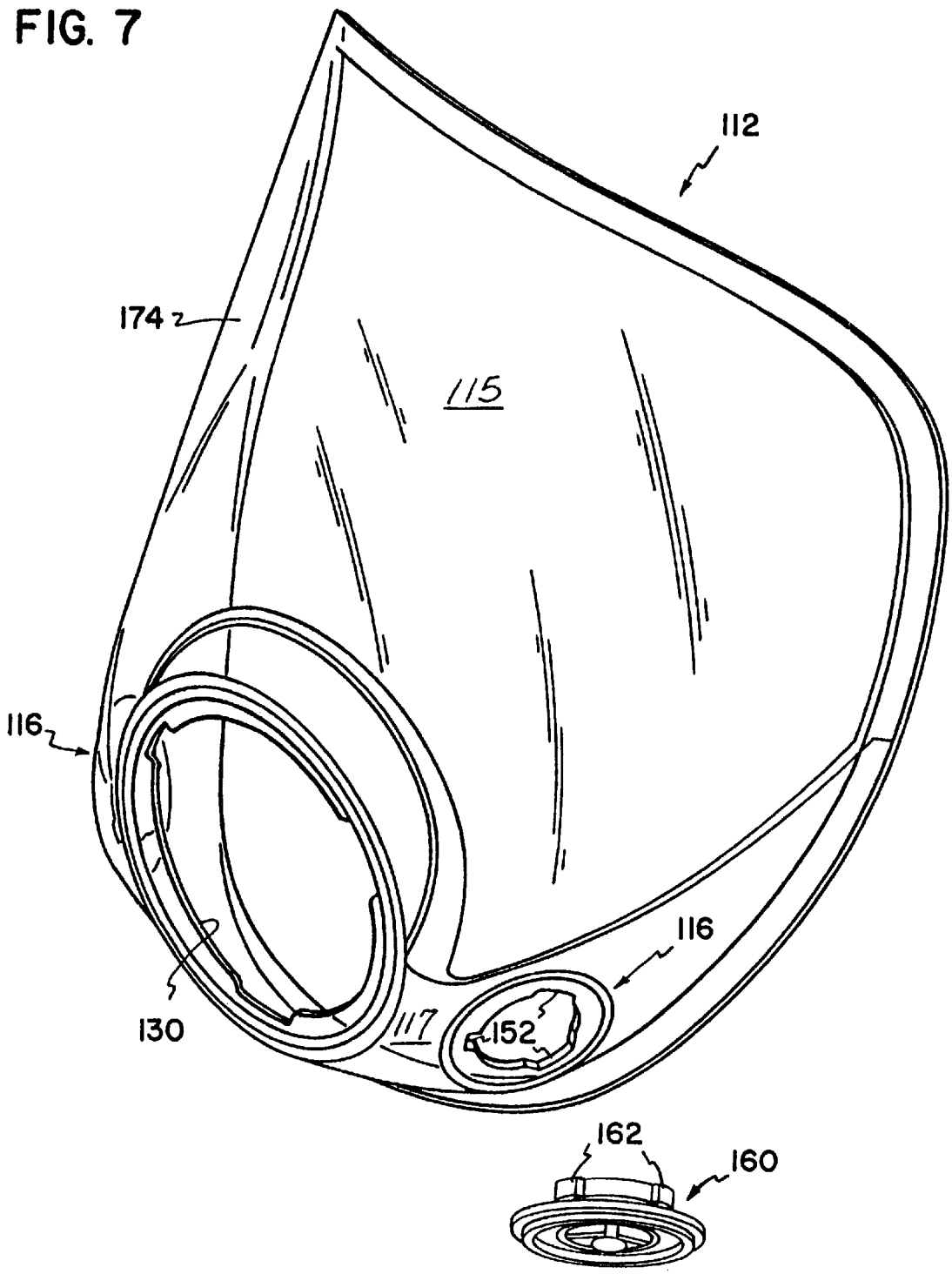
FIG. 7 shows a second embodiment of a lens and port element for the respirator shown in FIG. 1.
Figure 8:
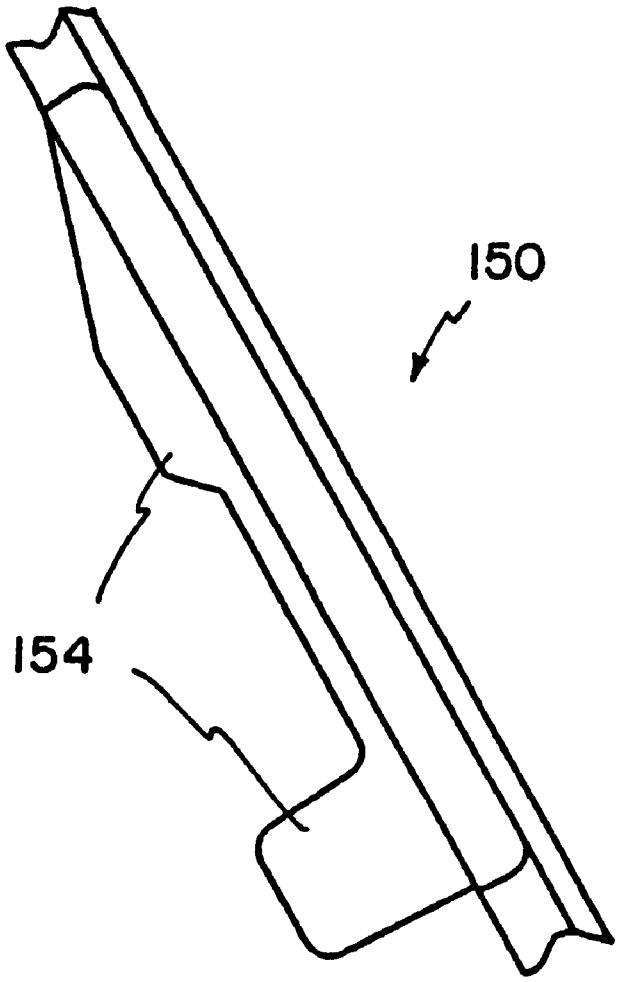
FIG. 8 shows a side detail view of the port portion and connector of the lens shown in FIG. 7.

In FIG. 7, there is shown a second embodiment of a face shield 112. The face shield 112 has a lens 114 that has a viewing portion 115 and a lower port portion 117. In a preferred embodiment, the face shield 112 includes a lens 114 with a center adapter 130 and a pair of inhalation ports 116 positioned at either side of the center adapter. The face shield 112 is similar to the face shield 12 except that the inhalation ports 116 each include a female connector 150 receiving a complementary male connector 160 of a breathable air source. The male connector 160 of the breathable air source includes radially outward extending tabs 162. The male connector 160 retains an inhalation valve and a gasket. The orifice of the female connector 150 has radially outward extending recesses 152 which are configured for receiving the complementary formed tabs 162. In addition, the female connector 150 includes tab retainer members 154, as shown in FIG. 8 which form slots for receiving the radially outward extending tabs 162. It can be appreciated that the male connector 160 from the breathable air source is connected to the female connector 150 by inserting the radially outward extending tabs 162 through the recesses 152. The male connector is then rotated to insert the tabs 162 into the slots formed by the tabbed retainer members 154 providing a positive locked position at the end of the slots. Separation is obtained by rotating the members in the opposite direction and pulling the male connector 160 away from the lens 114 with the tabs 162 passing through the recesses 152. In a preferred embodiment, the tabs 162 have differing heights and/or widths or are spaced at different intervals and the tab retainer members 154 form corresponding slots for orienting the male connector 160.

As shown in FIG. 6, the present invention may also include an embodiment to receive spectacles. Spectacle kit 70 attaches to the interior of the lens portion 14 for supporting spectacles properly aligned before a wearer's eyes. In addition, a neck strap 74 fits around the back of a wearer's head for carrying the respirator mask 10 when not worn. For certain applications, a lens cover 72 fits over an exterior upper section of the lens portion 14 for added protection.

It is to be understood that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A full face respirator mask that comprises:

(a) a rigid plastic lens that has a transparent viewing portion and a port portion, the port portion being disposed beneath the viewing portion when the mask is viewed from a front elevation;

(b) an exhalation port disposed in the port portion of the rigid plastic lens;

(c) first and second air intake ports disposed in the port portion of the rigid plastic lens on opposing sides of the exhalation port;

(d) first and second connectors that are integral with the rigid plastic lens in its port portion, the first and second connectors being configured for receiving first and second filter cartridges and being located on the port portion to allow intake air to be directed to the first and second intake ports, respectively; and (e) a face seal disposed on the full face respirator mask to seal the respirator over the wearer's eyes, nose, and mouth.

2. A mask according to claim 1, wherein the first and second connectors each have a positive locking position stop point when rotatably engaged with first and second filter cartridges, respectively.

3. A mask according to claim 1, wherein the first and second connectors each comprise a bayonet type connector for engaging first and second cartridges that each have a complementary connector configured for engaging the bayonet type connector.

4. A mask according to claim 1, wherein the connectors and face shield comprise a monolithic element.

5. A mask according to claim 4, wherein the connectors are molded with the full face shield.

6. A mask according to claim 4, wherein the connectors are ultrasonically welded to the face shield.

7. A mask according to claim 1, wherein the connectors are each directionally configured for orienting each of the attachable first and second cartridges to a predetermined position.

8. A mask according to claim 1, wherein the connectors each form an orifice therethrough and wherein each connector includes tabs extending radially outward, and wherein the tabs comprise different widths.

* * * * *